US007624875B1

(12) United States Patent
Hine et al.

(10) Patent No.: US 7,624,875 B1
(45) Date of Patent: Dec. 1, 2009

(54) INJECTION MOLDED BATTERY PACKAGE

(75) Inventors: David J. Hine, Skaneateles, NY (US); Tyler T. Watson, Auburn, NY (US); Mark A. Ferguson, Memphis, NY (US); Scott W. Osiecki, Skaneateles, NY (US)

(73) Assignee: Eveready Battery Co., Inc., St. Louis, MO (US)

( * ) Notice: Subject to any disclaimer, the term of this patent is extended or adjusted under 35 U.S.C. 154(b) by 9 days.

(21) Appl. No.: 12/145,682

(22) Filed: Jun. 25, 2008

(51) Int. Cl.
*B65D 85/88* (2006.01)

(52) U.S. Cl. ..... 206/705; 206/470

(58) Field of Classification Search ..... 206/703, 206/705, 461, 467, 470, 471, 775, 776
See application file for complete search history.

(56) References Cited

U.S. PATENT DOCUMENTS

| | | | | |
|---|---|---|---|---|
| 4,415,084 | A | 11/1983 | Hauser et al. | |
| 4,568,017 | A | 2/1986 | Grunert | |
| 4,784,268 | A | 11/1988 | Perchak | |
| 4,899,882 | A | 2/1990 | Benner | |
| 4,930,627 | A | 6/1990 | Borst et al. | |
| 4,962,849 | A | 10/1990 | Anderson | |
| 5,011,006 | A | 4/1991 | Anderson | |
| 5,012,927 | A | 5/1991 | Borst | |
| 5,038,936 | A | 8/1991 | Borst | |
| 5,143,215 | A * | 9/1992 | Hartley et al. | 206/705 |
| 5,147,035 | A | 9/1992 | Hartman | |
| 5,462,161 | A | 10/1995 | Halaburda et al. | |
| D393,799 | S | 4/1998 | Pope et al. | |
| 5,849,378 | A | 12/1998 | Gask | |
| 6,059,101 | A | 5/2000 | Gambardella et al. | |
| D432,909 | S | 10/2000 | Pirro et al. | |
| D433,629 | S | 11/2000 | Clarke et al. | |
| 6,244,444 | B1 | 6/2001 | Jacobus et al. | |
| 6,364,115 | B1 | 4/2002 | Casanova et al. | |
| 6,382,412 | B1 | 5/2002 | Wood | |
| 6,401,932 | B1 | 6/2002 | Weinstein et al. | |
| 6,427,841 | B2 | 8/2002 | Wani et al. | |
| 6,478,158 | B2 | 11/2002 | Gaffney et al. | |
| 6,679,630 | B2 | 1/2004 | Knoerzer et al. | |
| D489,253 | S | 5/2004 | Kumakura et al. | |
| D494,464 | S | 8/2004 | Kumakura et al. | |

(Continued)

FOREIGN PATENT DOCUMENTS

| | | |
|---|---|---|
| EP | 711713 | 3/1999 |

(Continued)

*Primary Examiner*—Jacob K Ackun, Jr.
(74) *Attorney, Agent, or Firm*—Russell H. Toye, Jr.

(57) ABSTRACT

A battery package comprising a rear member and a front member pivotally connected to the rear member. The battery package has a closed position and an open position allowing access to the interior space. The rear member includes support structure for supporting the batteries therein. The rear member including a foot and the front member and the rear member including aligned openings. Therefore, the battery package can alternatively be positioned on the horizontal surface using the foot and be hung on a rod by extending the rod through the aligned openings for display purposes. A first one of the front member and the rear member includes a latch and a second one of the front member and rear member includes a slot, with the latch being configured to be inserted into the slot for maintaining the battery package in the closed position.

25 Claims, 9 Drawing Sheets

U.S. PATENT DOCUMENTS

| | | | | |
|---|---|---|---|---|
| D497,547 | S | 10/2004 | Kumakura et al. | |
| D501,137 | S | 1/2005 | Fritz et al. | |
| 2001/0008240 | A1 | 7/2001 | Herrin | |
| 2002/0162771 | A1 | 11/2002 | Van Wagenen et al. | |
| 2004/0028855 | A1 | 2/2004 | Masuki et al. | |
| 2004/0214052 | A1 | 10/2004 | Rochelo | |
| 2006/0000738 | A1 | 1/2006 | Kumakura et al. | |
| 2006/0065570 | A1 * | 3/2006 | Martin et al. | 206/703 |
| 2006/0131208 | A1 * | 6/2006 | Morrison | 206/703 |
| 2007/0170087 | A1 * | 7/2007 | Narpes et al. | 206/703 |

FOREIGN PATENT DOCUMENTS

| | | |
|---|---|---|
| GB | 2053836 | 2/1981 |
| GB | 2327939 | 2/1999 |
| GB | 2413315 | 10/2005 |
| GB | 2422140 | 7/2006 |
| JP | 8324636 | 12/1996 |
| JP | 11227828 | 8/1999 |
| JP | 2003252332 | 9/2003 |

* cited by examiner

INJECTION MOLDED BATTERY PACKAGE

FIELD OF THE INVENTION

The present invention relates to packaging, and in particular to packaging for batteries.

SUMMARY OF THE PRESENT INVENTION

An aspect of the present invention is to provide a battery package comprising a rear member and a front member pivotally connected to the rear member. The front member is pivotable about the rear member at a pivot, with the battery package having a closed position wherein the front member is engaged with the rear member and defining an interior space therebetween. The battery package also includes an open position allowing access to the interior space. Batteries are in the interior space. At least one of the front member and the rear member includes support structure for supporting the batteries in the interior space. The rear member includes a foot allowing the battery package to stand substantially upright on a horizontal surface. A first one of the front member and the rear member includes a latch and a second one of the front member and rear member includes a slot, with the latch being configured to be inserted into the slot for maintaining the battery package in the closed position.

Another aspect of the present invention is to provide a battery package comprising a rear member and a front member pivotally connected to the rear member. The front member is pivotable about the rear member at a pivot, with the battery package having a closed position wherein the front member is engaged with the rear member and defining an interior space therebetween. The battery package also includes an open position allowing access to the interior space. Batteries are in the interior space. The front member and the rear member include aligned openings. A first one of the front member and the rear member includes a latch and a second one of the front member and rear member includes a slot, with the latch being configured to be inserted into the slot for maintaining the battery package in the closed position. The battery package can be hung on a rod by extending the rod through the aligned openings for display purposes.

Yet another aspect of the present invention is to provide a package comprising a rear member and a front member pivotally connected to the rear member. The front member is pivotable about the rear member at a pivot, with the package having a closed position wherein the front member is engaged with the rear member and defining an interior space therebetween. The package also includes an open position allowing access to the interior space. The rear member includes support structure for supporting products in the interior space. The rear member also includes a foot allowing the package to stand substantially upright on a horizontal surface. The front member and the rear member include aligned openings. A first one of the front member and the rear member includes a latch and a second one of the front member and rear member includes a slot, with the latch being configured to be inserted into the slot for maintaining the package in the closed position. Therefore, the package can alternatively be positioned on the horizontal surface using the foot and be hung on a rod by extending the rod through the aligned openings for display purposes.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
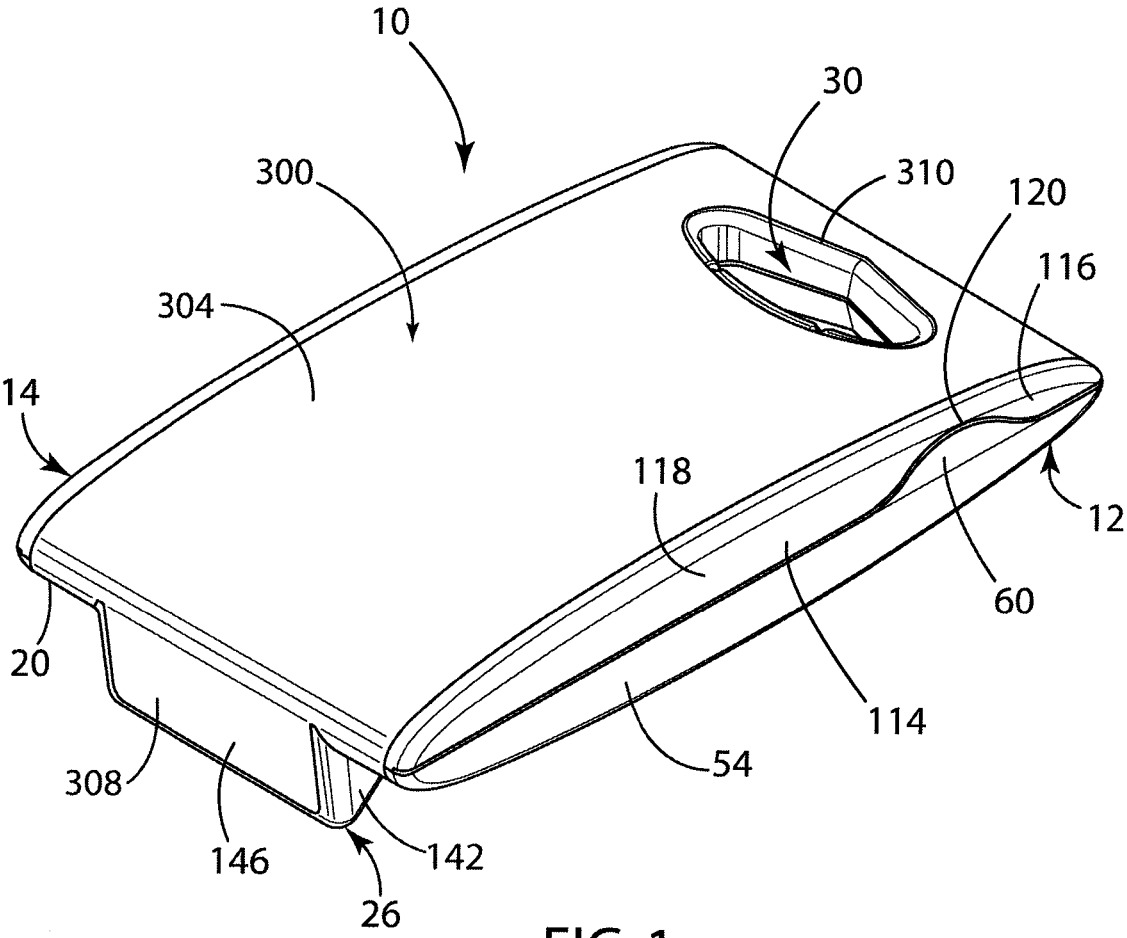
FIG. 1 is a perspective view of a battery package of the present invention in a closed configuration.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2A:
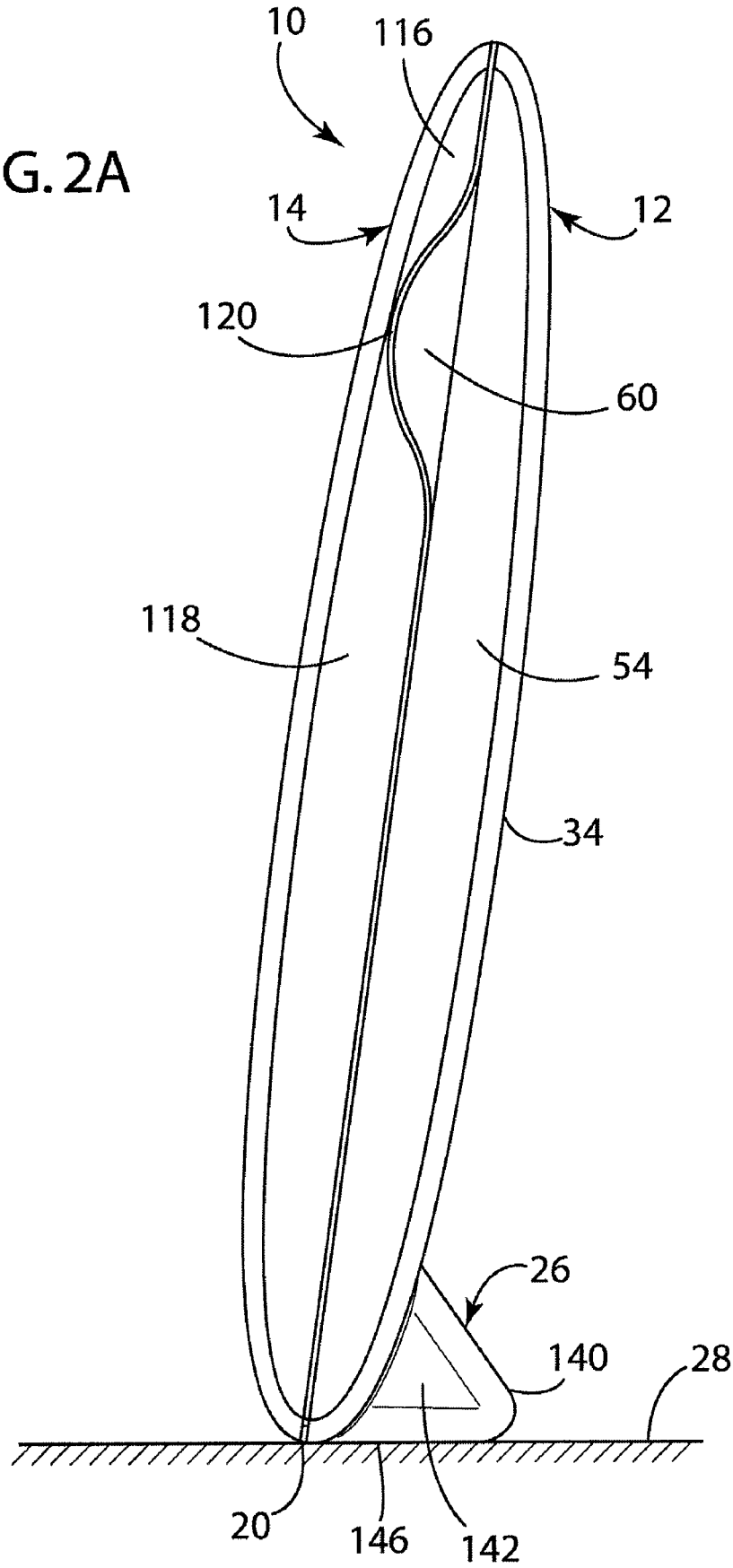
FIG. 2A is a side view of the battery package of the present invention in the closed configuration.

The reference number 10 (FIGS. 1-3 and 8) generally designates a package embodying the present invention. In the illustrated example, the package 10 comprises a rear member 12 and a front member 14 pivotally connected to the rear member 12. The front member 14 is pivotable about the rear member 12 at a pivot 20. The package 10 has a closed position (see FIG. 2A) wherein the front member 14 is engaged with the rear member 12 and defines an interior space 22 therebetween. The package 10 also has an open position (see FIG. 2B) allowing access to the interior space 22. The rear member 12 includes support structure 24 for supporting products in the interior space 22. The rear member 12 also includes a foot 26 allowing the package 10 to stand substantially upright on a horizontal surface 28 (see FIG. 2A). The front member 14 and the rear member 12 include aligned openings 30. A first one of the front member 14 and the rear member 12 includes a latch 400 and a second one of the front member 14 and rear member 12 includes a slot 402, with the latch 400 being configured to be inserted into the slot 402 for maintaining the package 10 in the closed position. The package 10 can alternatively be positioned on the horizontal surface 28 using the foot 26 and be hung on a rod (not shown) by extending the rod through the aligned openings 30 for display purposes. In the illustrated example, the products located within the package 10 are batteries 16. It is noted that FIG. 3 only shows one battery 16 for illustrative purposes. However, it is understood that more than one battery 16 can be located within the package 10 (see, for example, FIG. 8). It is contemplated that the products located within the package 10 could be any commercially available product.

The illustrated batteries 16 within the package 10 can comprise electrochemical cells for supplying voltage to battery powered devices. The batteries 16 can comprise any of the popular alkaline or lithium cells of the generally cylindrical shape that are commercially available in industry-recognized, standard sizes, including D-, C-, AA-, AAA-, and AAAA-size cells, as well as other sizes and configurations (e.g., 9 volt batteries). Alternatively, disc-shaped batteries commercially available for small electrically operated devices, such as hearing aids, could be used. In the illustrated embodiment, the package 10 includes four aligned cylindrical batteries 16 therein. However, it is contemplated that the package 10 could include any number of batteries 16 therein. Furthermore, it is contemplated that the package 10 could include different batteries 16 and/or a plurality of different size batteries 16.

In the illustrated example, the rear member 12 (FIGS. 4 and 5) includes the support structure 24 for supporting the products 16. However, it is contemplated that the front member 14 could include the support structure 24 for supporting the products 16 or that the front member 14 and the rear member 12 could each have support structure and work in combination (or separately) to support the products 16 in the interior space 22.

Figure 4:
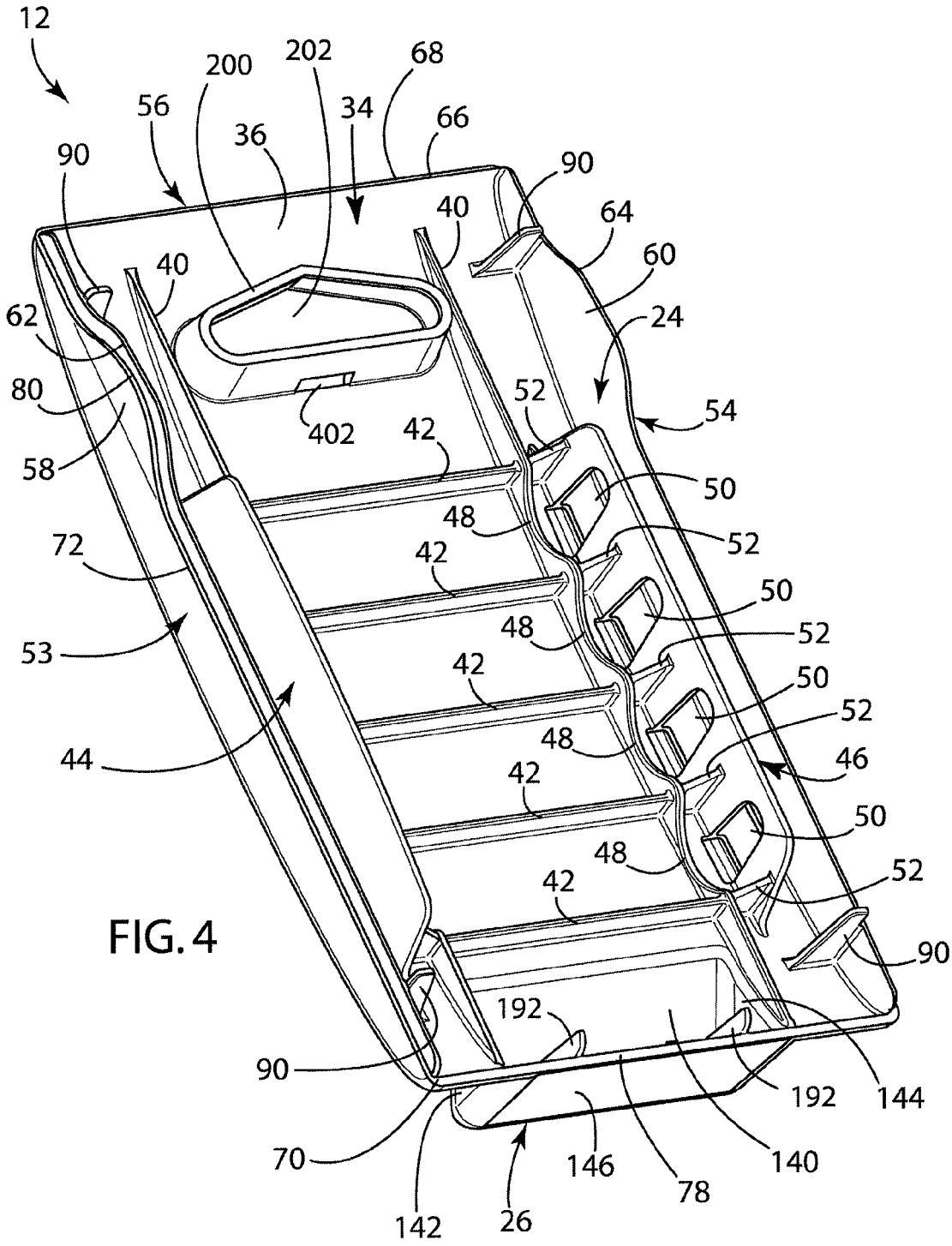
FIG. 4 is a front perspective view of a rear member of the battery package of the present invention.
Figure 5:
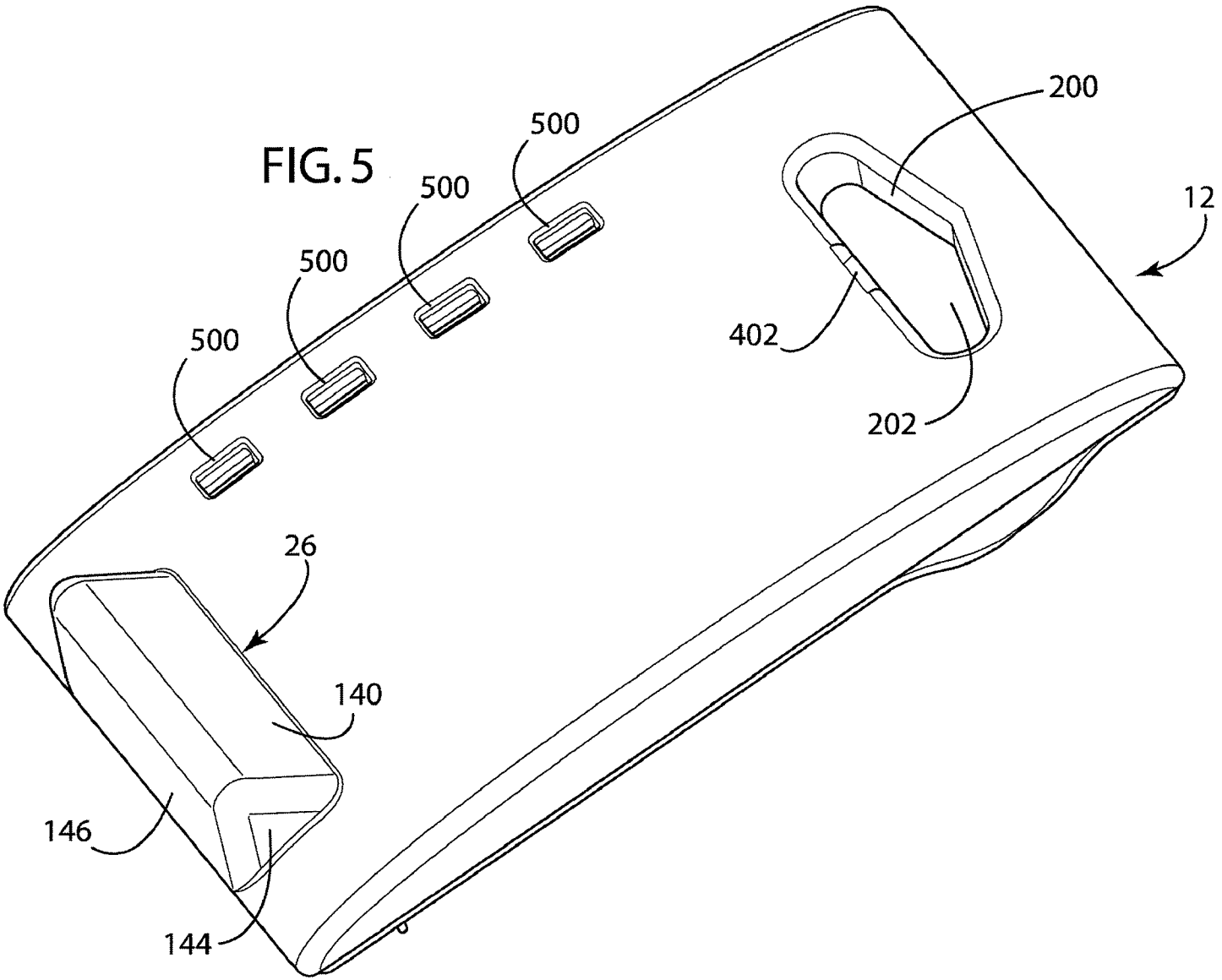
FIG. 5 is a rear perspective view of the rear member of the battery package of the present invention.
Figure 8:
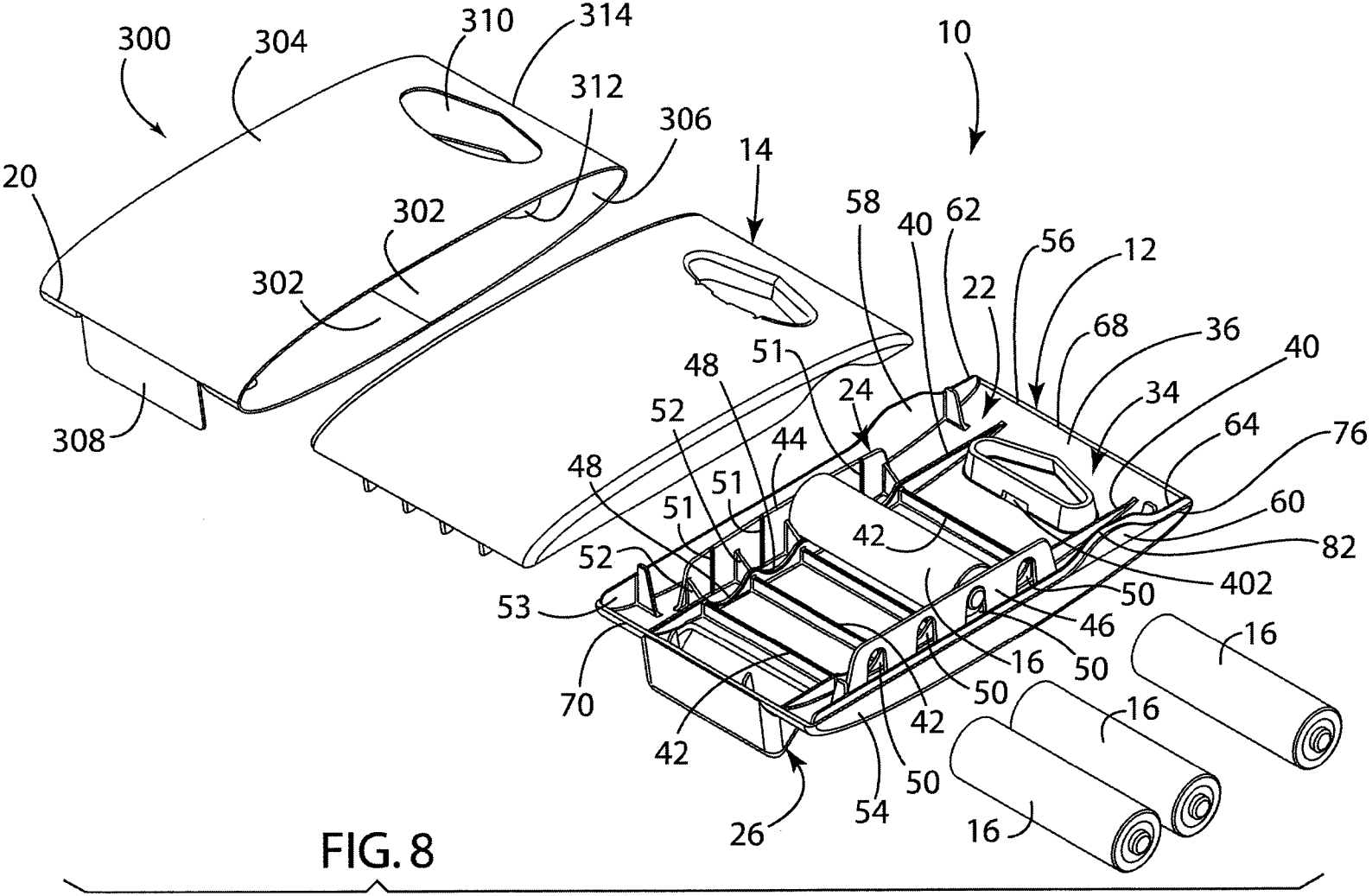
FIG. 8 is an exploded perspective view of the battery package of the present invention.

The illustrated rear member 12 is configured to support the products 16 from the rear. The rear member 12 includes a bowed rear section 34 having a front surface 36 for accepting the products 16 thereon. In the illustrated embodiment, the products 16 comprise four cylindrical batteries 16. However, as discussed above, any number and shape of batteries or any product could be used. As illustrated in FIGS. 4 and 8, the support structure 24 includes a pair of parallel support ribs 40, a plurality of cross-pieces 42, a first side product support wedge wall 44 and a second side product support wedge wall 46. The pair of parallel support ribs 40 extend from the front surface 36 in a vertical orientation. The support ribs 40 include a plurality of grooves 48 for accepting the batteries 16 thereon. As illustrated in FIGS. 4 and 8, each of the support ribs 40 include one of a pair of aligned grooves 48, with each end of one of the batteries 16 resting in one of the aligned grooves 48. In the illustrated example, the grooves 48 are annular to support an outer cylindrical surface of the batteries 16. However, it is contemplated that the grooves 48 could be any shape to accommodate the batteries 16 or other product in the package 10. For example, the grooves 48 could be triangular, three sides of a rectangle or any other shape configured to support ends of the batteries 16 or other products. It is also contemplated that additional support ribs 40 could be employed to support middle sections of the batteries 16 or the other products. The plurality of cross-pieces 42 extend between the parallel support ribs 40. The cross-pieces 42 provide support for the support structure 24 and the rear member 12. In the illustrated embodiment, five cross-pieces 42 are used. However, it is contemplated that any number of cross-pieces 42 (including none) could be used.

In the illustrated example, the first side product support wedge wall 44 and the second side product support wedge wall 46 maintain the batteries 16 on the support structure 24. The batteries 16 are configured to be wedged between the first side product support wedge wall 44 and the second side product support wedge wall 46 to maintain the batteries 16 on the support ribs 40. In the illustrated example, the second side product support wedge wall 46 includes a plurality of product extension openings 50. As illustrated in FIG. 8, an extension of the batteries 16 (e.g., a positive terminal) is configured to extend into one of the product extension openings 50 to assist in maintaining the batteries 16 between the first side product support wedge wall 44 and the second side product support wedge wall 46 and on the support ribs 40. It is contemplated that the first side product support wedge wall 44 could include a plurality of tabs 51 aligned with the product extension openings 50 to push the product (e.g., at a negative terminal of the batteries 16) into the openings 50. While the product extension openings 50 are illustrated as being in the second side product support wedge wall 46 and the tabs 51 are illustrated as being on the first side product support wedge wall 44, it is contemplated that the product extension openings 50 and the tabs 51 could be located in or on either or both of the first side product support wedge wall 44 and the second side product support wedge wall 46. It is further contemplated that struts 52 could extend between the support ribs 40 and each of the first side product support wedge wall 44 and the second side product support wedge wall 46 to provide stability to the first side product support wedge wall 44 and the second side product support wedge wall 46. Furthermore, it is contemplated that the support structure 24 could have a different configuration than that outlined herein. For example, the support structure 24 could capture the batteries 16 using grooves in walls, with the grooves extending more than 180° to be able to capture the batteries 16. Moreover, it is contemplated that the support structure 24 could only maintain the batteries 16 in position when the package 10 is in the closed position.

The illustrated rear member 12 can also include structure for providing stability to and for supporting the package 10. For example, the rear member 12 can include a first side wall 53 connected to a first side of the bowed rear section 34, a second side wall 54 connected to a second side of the bowed rear section 34 and a short top wall 56 connected to a top of the bowed rear section 34. The first side wall 53 includes a first side raised portion 58 and the second side wall 54 includes a second side raised portion 60 adjacent a top of the bowed rear section 34. The first side wall 53, the second side wall 54 and the short top wall 56 include a first side upper surface 62, a second side upper surface 64 and a top upper surface 66, respectively. The first side upper surface 62, the second side upper surface 64 and the top upper surface 66 defines an inverted U-shaped upper surface 68. The rear member 12 can include a plurality of support flanges 90 extending between each of the first side wall 53 and the second side wall 54 and the bowed rear section 34 to provide stability to the rear member 12. A substantially rectangular rim 70 surrounds the bowed rear section 34. The rim 70 includes a first side 72 located below and outside of the first side upper surface 62, a top side 74 (see FIG. 3) located above and outside the top upper surface 66, a second side 76 located below and outside of the second side upper surface 64 and a bottom side 78 extending between the first side 72 and the second side 76. The first side 72 of the rim 70 includes a first side raised rim portion 80 substantially following the contour of the first side raised portion 58 of the first side wall 53 and the second side 76 of the rim 70 includes a second side raised rim portion 82 substantially following the contour of the of the second side raised portion 60 of the rim 70. The first side wall 53, the second side wall 54 and the rim 70 work with the front member 14 to maintain the package 10 in the closed position.

Figure 6:
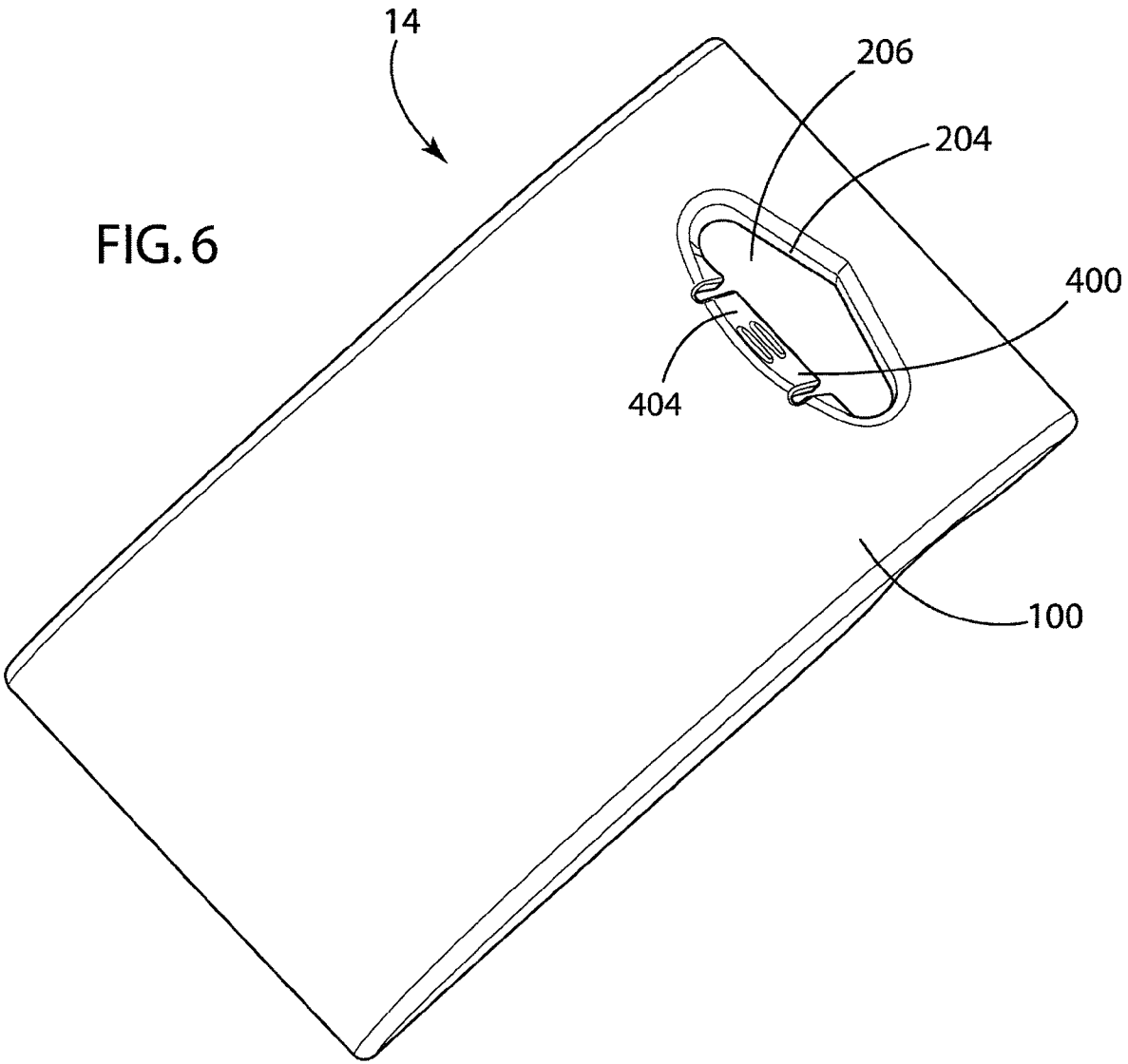
FIG. 6 is a front perspective view of a front member of the battery package of the present invention.
Figure 7:
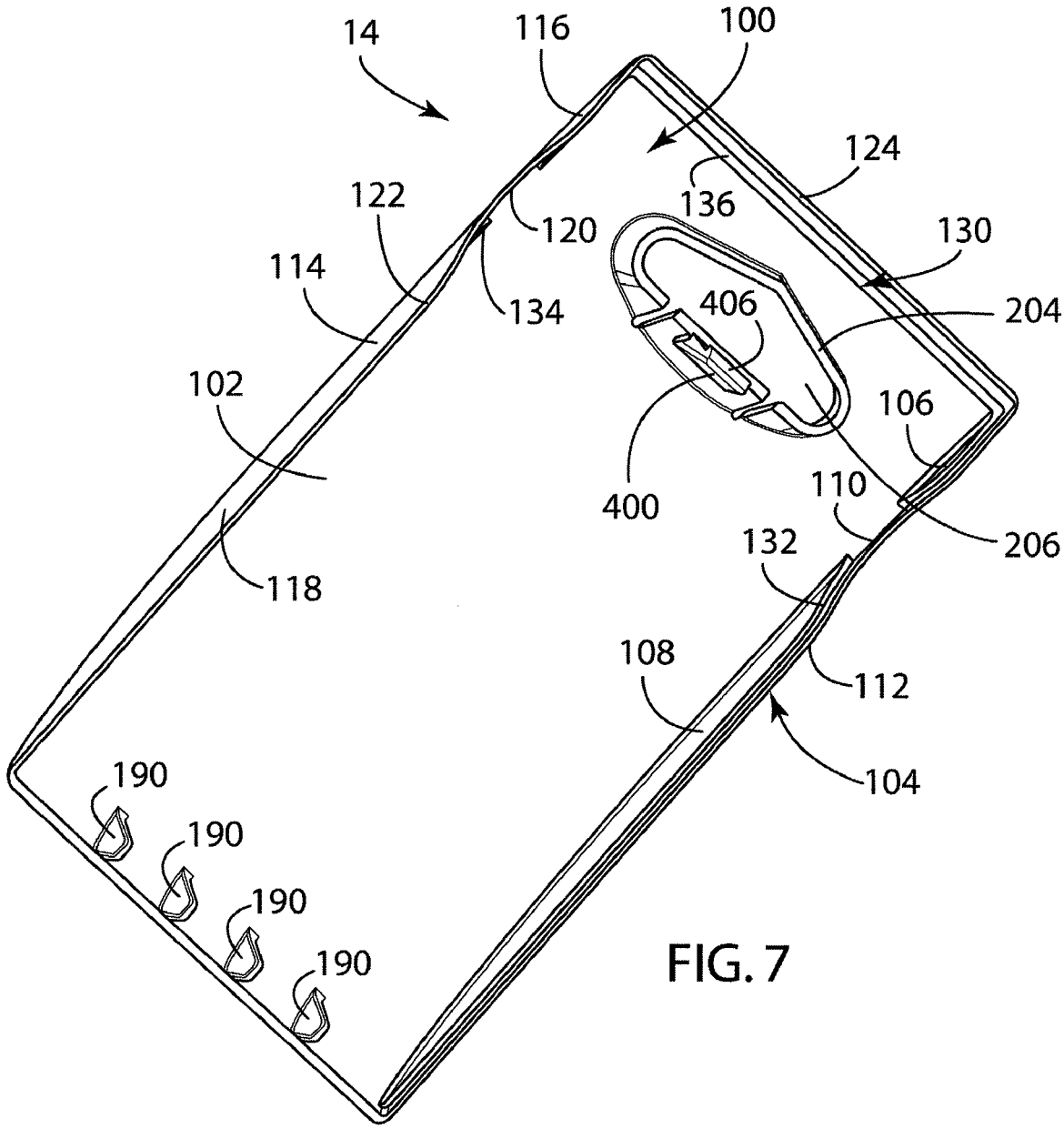
FIG. 7 is a rear perspective view of the front member of the battery package of the present invention.

In the illustrated example, the front member 14 (FIGS. 6 and 7) is functionally connected to the rear member 12 and defines the interior space 22 when the package 10 is in the closed position. The front member 14 includes a bowed front section 100 having a rear surface 102. The illustrated front member 14 can also include a structure for providing stability to and for supporting the package 10. For example, the front member 14 can include a first side wall 104 connected to a first side thereof and having a top shorter portion 106 and a bottom longer portion 108 separated by a groove 110 located between the top shorter portion 106 and the bottom longer portion 108. The first side wall 104 includes a first side upper surface 112 having the same contour as the first side 72 of the rim 70 of the rear member 12. The front member 14 can also include a second side wall 114 connected to a second side thereof and having a top shorter portion 116 and a bottom longer portion 118 separated by a groove 120 located between the top shorter portion 116 and the bottom longer portion 118. The second side wall 114 includes a second side upper surface 122 having the same contour as the second side 76 of the rim 70 of the rear member 12. The front member 14 also include a top wall 124 connected to a top of the bowed front section 100 and tops of the first side wall 104 and the second side wall 114. An inner ledge 130 is located on an inside of the first side wall 104, the second side wall 114 and the top wall 124 of the front member 14. The inner ledge 130 includes a first side lower surface 132 conforming to the contour of the first side upper surface 62 of the first side wall 53 of the rear member 12, a second side lower surface 134 conforming to the contour of the second side upper surface 64 of the second side wall 54 of the rear member 12, and a top lower surface 136 conforming to the top upper surface 66 of the short top wall 56 of the rear member 12. As discussed in more detail below, the inner ledge 130, the first side wall 104, the second side wall 114 and the top wall 124 of the front member 14 work with the first side wall 53, the second side wall 54 and the rim 70 of the ream member 12 to maintain the package 10 in the closed position.

As discussed above, the package 10 includes at least two features for displaying the package 10: the foot 26 and the aligned openings 18. The illustrated rear member 12 includes the foot 26, which allows the package 10 to stand substantially upright on the horizontal surface 28 (see FIG. 2). The foot 26 comprises an angled top wall 140, a first side wall 142, a second side wall 144 and a bottom wall 146. The angled top wall 140 extends rearwardly from an area adjacent a bottom of the bowed rear section 34. The bottom wall 146 extends rearwardly from a bottom of the bowed rear section 34 above the bottom side 78 of the rim 70. The first side wall 142 and the second side wall 144 are substantially triangular and are each connected to the angled top wall 140, the bottom wall 146 and the bowed rear section 34 of the rear member 12. As illustrated in FIG. 2, the bottom wall 146 acts to allow the package 10 to stand substantially upright on the horizontal surface 28. It is contemplated that the foot 26 could have other configurations that allow the package 10 to stand substantially upright on the horizontal surface 28. For example, the walls could be curved and/or have any peripheral shape.

In the illustrated example, the package 10 can include a feature for allowing the package 10 to be hung from a display rack (not shown): the aligned openings 30. The rear member 12 includes a rear hanging opening tube 200 having a rear central opening 202. The front member 14 includes a front hanging opening tube 204 having a front central opening 206. The front hanging opening tube 204 is aligned with the rear hanging opening tube 200 such that the front central opening 206 is aligned with the rear central opening 202 of the rear hanging opening tube 200 (see FIG. 2A). In the illustrated embodiment, the aligned openings 30 comprise the rear central opening 202 and the front central opening 206, which are configured to accept a hanger rod (not shown) typically used to display batteries in a store as is well known to those skilled in the art therein.

FIG. 8 illustrates an exploded view of the package 10 during assembly of the package 10. In assembling the package 10, the battery package is positioned in the open position and the batteries 16 are placed within the support structure 24 as described above. The front member 14 is then moved into position over the rear member 12 by having the first side upper surface 112 of the first side wall 104 of the front member 14 abut the first side 72 of the rim 70 of the rear member 12, by having the second side upper surface 122 of the second side wall 114 of the front member 14 abut the second side 76 of the rim 70 of the rear member 12, by having the top wall 124 of the front member 14 abut the top side 74 of the rim 70 of the rear member, by having a bottom edge of the bowed front section 100 of the front member 14 abut a bottom edge of the bowed rear section 34 of the rear member 12, by having the first side lower surface 132 of the inner ledge 130 of the front member 14 abut the first side upper surface 62 of the first side wall 53 of the rear member 12, by having the second side lower surface 134 of the inner ledge 130 of the front member 14 abut the second side upper surface 64 of the second side wall 54 of the rear member 12, and by having the top lower surface 136 of the inner ledge 130 of the front member 14 abut the top upper surface 66 of the short top wall 56 of the rear member 12. In the illustrated embodiment, the front member 14 can include front alignment tabs 190 extending rearwardly from a bottom of the bowed front section 100 (see FIG. 7). The front alignment tabs 190 are configured to abut a top inside surface of the bottom wall 146 of the foot 26 (see FIG. 3) to assist with alignment of the front member 14 with the rear member 12. Likewise, the rear member 12 can include rear alignment tabs 192 extending forwardly from the top inside surface of the bottom wall 146 of the foot 26 (see FIG. 4). The rear alignment tabs 192 are configured to abut the rear surface 102 of the bowed front section 100 to assist with alignment of the front member 14 with the rear member 12.

Figure 2B:
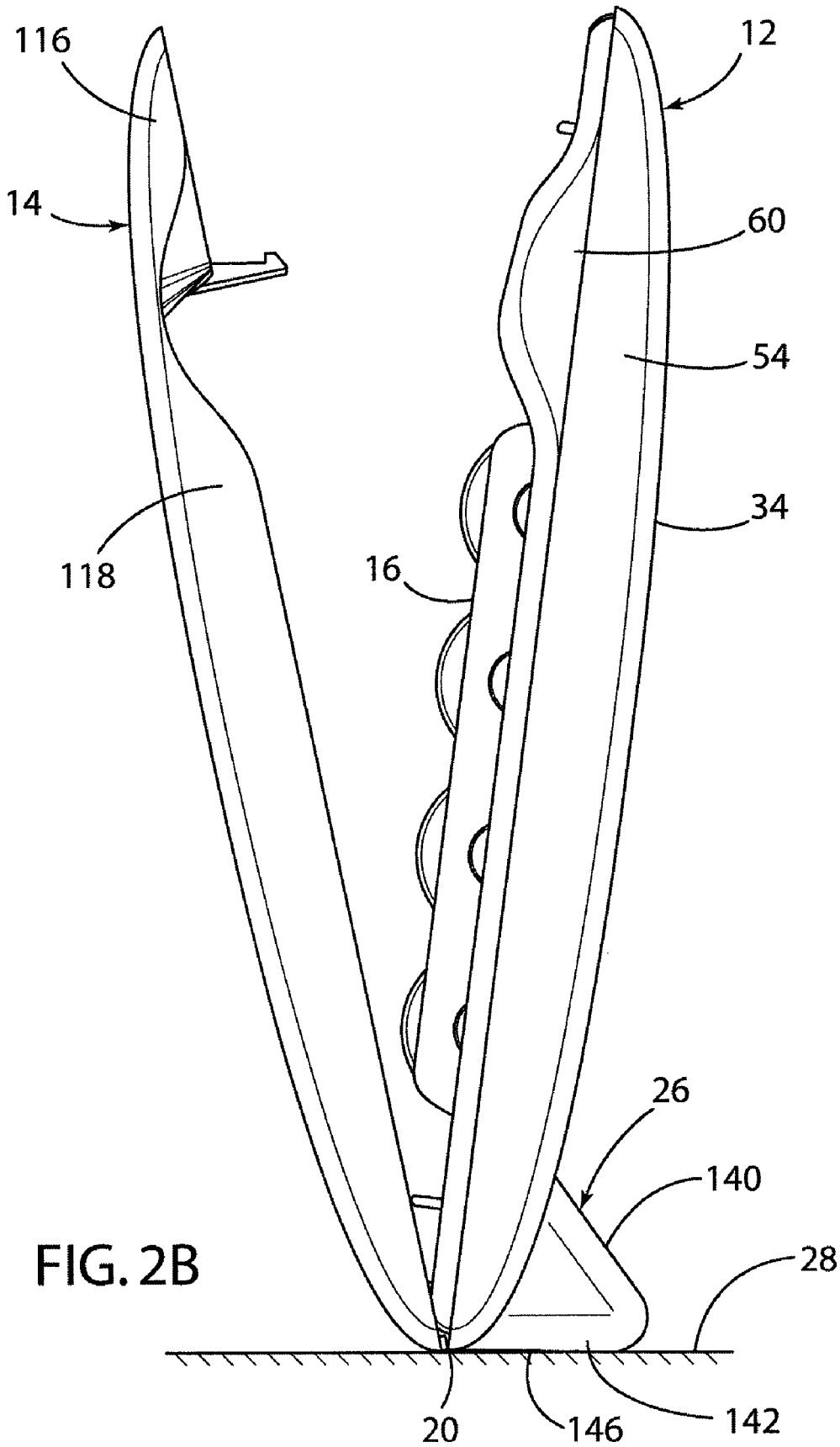
FIG. 2B is a side view of the battery package of the present invention in an open configuration.
Figure 3:
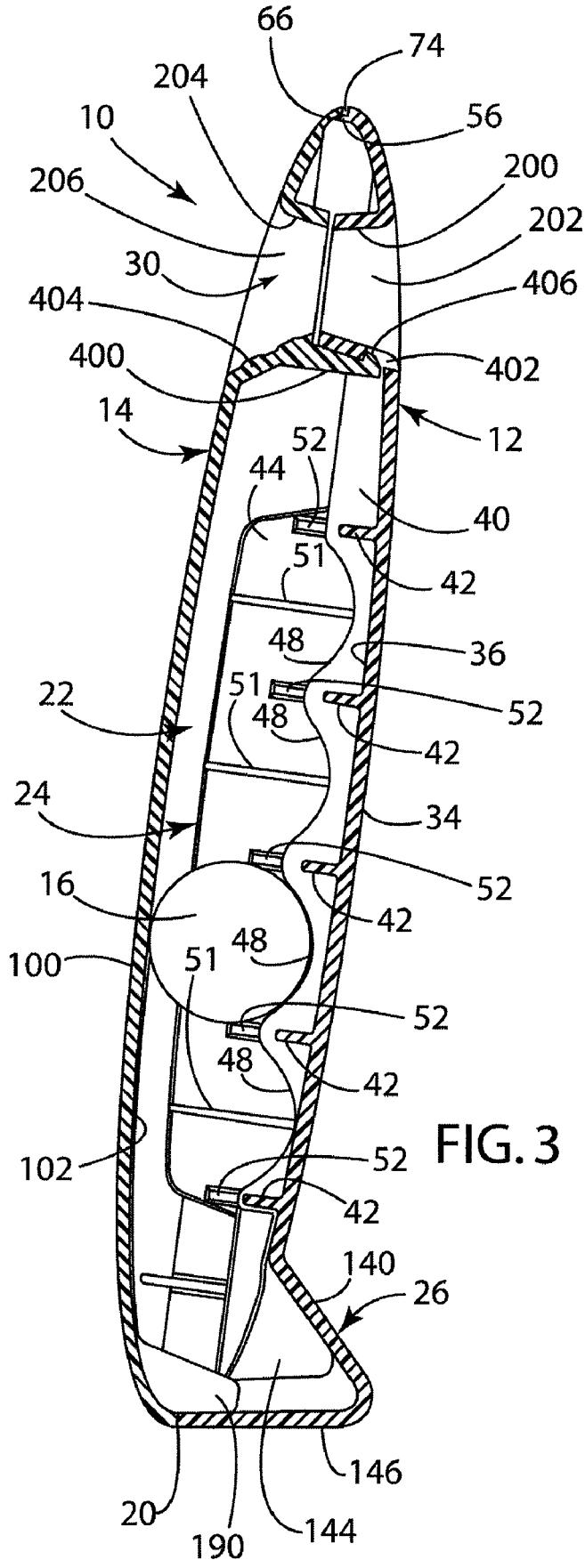
FIG. 3 is a cross-sectional perspective view of the battery package of the present invention.

In the illustrated example, a sleeve 300 is placed over the front member 14 and rear member 12 after the products are placed onto the support structure 24 in the interior space 22 as described above. The sleeve 300 is initially an elongated piece of material that wraps around the front member 14 and the rear member 12, with ends 302 of the elongated piece of material meeting at a middle portion of the rear member 12 (see FIG. 8). Once over the front member 14 and the rear member 12, the sleeve 300 has a front portion 304 over the front member 14, a rear portion 306 over the rear member 12 and a foot tab 308 over the bottom wall 146 of the foot 26. The front portion 304 of the sleeve 300 includes a front aperture 310 to allow access to the aligned openings 30 and the rear portion 306 of the sleeve 300 includes a rear aperture 312 to allow access to the aligned openings 30. While the ends 302 of the elongated piece of material are shown as meeting at the middle portion of the rear member 12, it is contemplated that the ends 302 could meet anywhere on the front member 14 or the rear member 12 and that the ends 302 could be spaced from each other and even on different ones of the front member 14 and the rear member 12. As illustrated in FIG. 2B, the sleeve 300 connects a bottom of the front member 14 and the rear member 12 and defines the pivot 20 that allows the front member 14 to pivot about the rear member 12 between the open and closed positions. However, it is contemplated that the front member 14 could be connected to the rear member 12 in other manners (e.g., a living hinge) and that the pivot 20 could be located at a bottom of the package 10, at a top of the package 10 or on the sides of the package 10. It is further contemplated that the sleeve 300 could include a tear strip 314 at a top of the sleeve 300 between the front portion 304 and the rear portion 306, whereby the package 10 can be moved to the open position by removing the tear strip 314, thereby allowing the front portion 304 of the sleeve 300 and the front member 14 to rotate relative to the rear portion 306 of the sleeve 300 and the rear member 12 at the pivot 20. In the illustrated example, the sleeve 30 is adhesively connected to the front member 14 and the rear member 12.

As described above, a first one of the front member 14 and the rear member 12 includes the latch 400 and a second one of the front member 14 and rear member 12 includes the slot 402, with the latch 400 being configured to be inserted into the slot 402 for maintaining the package 10 in the closed position. In the illustrated example, the front member 14 includes the latch 400 and the rear member 12 includes the slot 402. However, it is contemplated that the rear member 12 could include the latch 400 and the front member 14 could include the slot 402. In the illustrated embodiment, the latch 400 (FIGS. 3, 6 and 7) forms part of the front hanging opening tube 204 of the front member 14 and includes a press plate 404 and a tab 406 at the end of the press plate 404. The slot 402 (FIGS. 3-5) is formed in a bottom of the rear hanging opening tube 200 of the rear member 12. While in the closed position, the tab 406 of the latch 400 is in the slot 402 (see FIG. 3), thereby maintaining the package 10 in the closed position. To move the package 10 to the open position, the press plate 404 is moved downward, thereby moving the tab 406 of the latch 400 out of the slot 402 and allowing the package 10 to move to the open position. While the latch 400 and the slot 402 are illustrated as forming part of the front hanging opening tube 204 of the front member 14 and the rear hanging opening tube 200 of the rear member 12, it is contemplated that the latch 400 and the slot 402 could form their own structure on the front and rear members, could be located on the side, top or bottom walls of the front and rear members or could be located elsewhere. Furthermore, while the slot 402 is illustrated as extending all of the way through the rear hanging opening tube 200, it is contemplated that the slot 402 could be formed in a closed recess (such that an end of the slot is not open).

The illustrated package 10 can be easily formed and batteries can easily be packaged in the package 10. It is contemplated that the front member 14 and the rear member 12 can be injection molded. If injection molded or molding in other fashions, the rear member 12 could include holes 500 (see FIG. 5) for allowing a portion of the mold to form the plurality of product extension openings 50 in the second side product support wedge wall 46 (or the first side product wedge support wall 44). The batteries 16 can also be placed onto the rear member 12 and the package 10 can be moved to the closed configuration to thereby package the batteries 16 in the package 10. It is also contemplated that the package 10 can be formed of any formable material (e.g., plastic (e.g., PETG)) and can be formed or molded in any manner. It is also contemplated that the package 10 could be injection molded and made of plastic. Furthermore, it is contemplated that any portion or the entire package 10 can be transparent, translucent or opaque. It is also contemplated that a sleeve 300 can include material printed thereon for advertising or informational purposes. Furthermore, it is contemplated that the package 10 can be inclined on the support surface (as illustrated in FIG. 2A) or can be vertical relative to the support surface. Moreover, it is contemplated that the package 10 could be entirely or almost entirely covered by a shrink wrap sleeve.

It is to be understood that variations and modifications can be made on the aforementioned structure without departing from the concepts of the present invention. It is to be understood that such concepts as described herein are intended to be covered by the following claims unless these claims by their language expressly state otherwise.

We claim:

1. A battery package comprising:

a rear member;

a front member pivotally connected to the rear member;

the front member being pivotable about the rear member at a pivot, with the battery package having a closed position wherein the front member is engaged with the rear member and defining an interior space therebetween, the battery package also including an open position allowing access to the interior space;

batteries in the interior space;

at least one of the front member and the rear member including support structure for supporting the batteries in the interior space;

the rear member including a foot allowing the battery package to stand substantially upright on a horizontal surface;

a first one of the front member and the rear member including a latch and a second one of the front member and rear member including a slot, the latch being configured to be inserted into the slot for maintaining the battery package in the closed position.

2. The battery package of claim 1, wherein:

the front member and the rear member include aligned openings;

the battery package can alternatively be positioned on the horizontal surface and be hung on a rod by extending the rod through the aligned openings for display purposes.

3. The battery package of claim 2, wherein:

the front member includes a front tube having a front one of the aligned openings therein and the rear member includes a rear tube having a rear one of the aligned openings therein.

4. The battery package of claim 3, wherein:

the latch forms a portion of the front tube and the opening is located on the rear tube.

5. The battery package of claim 1, wherein:

a sleeve surrounds at least a portion of the front member and the rear member, the sleeve forming the pivot.

6. The battery package of claim 5, wherein:

the sleeve includes a tear strip, wherein the tear strip is removed to allow the battery package to move from the closed position to the open position.

7. The battery package of claim 1, wherein:

the front member and the rear member are injection molded.

8. The battery package of claim 1, wherein:

the latch is located on the front member and the slot is located in the rear member.

9. The battery package of claim 1, wherein:

the foot includes a bottom surface and a wall extending from a rear surface of the rear member, the bottom surface of the foot and the wall forming an intersection, with the bottom surface abutting the horizontal surface when the battery package is positioned on the horizontal surface.

10. The battery package of claim 1, wherein:

the support structure comprises a pair of aligned wedge walls for maintaining the batteries on the support structure;

the batteries are cylindrical and have a positive terminal and a negative terminal at ends of the cylinder; and the ends of the cylinder are wedged between the wedge walls.

11. The battery package of claim 10, wherein:

the support structure also includes a plurality of grooves for accepting the cylinder thereon.

12. The battery package of claim 10, wherein:

at least one of the wedge walls includes a plurality of openings therethrough for accepting the positive terminal therein.

13. The battery package of claim 1, wherein:

the support structure is located on the rear member.

14. A battery package comprising:

a rear member;

a front member pivotally connected to the rear member;

the front member being pivotable about the rear member at a pivot, with the battery package having a closed position wherein the front member is engaged with the rear member and defining an interior space therebetween, the battery package also including an open position allowing access to the interior space;

batteries in the interior space;

the front member and the rear member including aligned openings;

a first one of the front member and the rear member including a latch and a second one of the front member and rear member including a slot, the latch being configured to be inserted into the slot for maintaining the battery package in the closed position;

wherein the battery package can be hung on a rod by extending the rod through the aligned openings for display purposes.

15. The battery package of claim 14, wherein:

the front member includes a front tube having a front one of the aligned openings therein and the rear member includes a rear tube having a rear one of the aligned openings therein.

16. The battery package of claim 15, wherein:

the latch forms a portion of the front tube and the opening is located on the rear tube.

17. The battery package of claim 14, wherein:

a sleeve surrounds at least a portion of the front member and the rear member, the sleeve forming the pivot.

18. The battery package of claim 14, wherein:

the front member and the rear member are injection molded.

19. The battery package of claim 14, wherein:

the latch is located on the front member and the slot is located in the rear member.

20. The battery package of claim 14, wherein:

the foot includes a bottom surface and a wall extending from a rear surface of the rear member, the bottom surface of the foot and the wall forming an intersection, with the bottom surface abutting the horizontal surface when the battery package is positioned on the horizontal surface.

21. The battery package of claim 14, wherein:

the support structure comprises a pair of aligned wedge walls for maintaining the batteries on the support structure;

the batteries are cylindrical and have a positive terminal and a negative terminal at ends of the cylinder; and the ends of the cylinder are wedged between the wedge walls.

22. The battery package of claim 21, wherein:

the support structure also includes a plurality of grooves for accepting the cylinder thereon.

23. The battery package of claim 21, wherein:

at least one of the wedge walls includes a plurality of openings therethrough for accepting the positive terminal therein.

24. The battery package of claim 14, wherein:

the support structure is located on the rear member.

25. A package comprising:

a rear member; and a front member pivotally connected to the rear member;

the front member being pivotable about the rear member at a pivot, with the package having a closed position wherein the front member is engaged with the rear member and defining an interior space therebetween, the package also including an open position allowing access to the interior space;

the rear member including support structure for supporting products in the interior space;

the rear member including a foot allowing the package to stand substantially upright on a horizontal surface;

the front member and the rear member including aligned openings;

a first one of the front member and the rear member including a latch and a second one of the front member and rear member including a slot, the latch being configured to be inserted into the slot for maintaining the package in the closed position;

wherein the package can alternatively be positioned on the horizontal surface using the foot and be hung on a rod by extending the rod through the aligned openings for display purposes.

* * * * *